US005153360A

United States Patent [19]

Upton

[11] Patent Number: 5,153,360

[45] Date of Patent: Oct. 6, 1992

[54] GUN LOCK

[75] Inventor: Bruce Upton, Roseville, Australia

[73] Assignee: Upton Industries Pty. Ltd., New South Wales, Australia

[21] Appl. No.: 775,790

[22] Filed: Oct. 11, 1991

[30] Foreign Application Priority Data

Oct. 19, 1990 [AU] Australia ..... PK2899

[51] Int. Cl.[5] ..... F41A 17/02; F41A 17/54

[52] U.S. Cl. ..... 42/70.11; 42/70.07

[58] Field of Search ..... 42/70.11, 70.06, 70.07, 42/70.04

[56] References Cited

U.S. PATENT DOCUMENTS 1,686,482 10/1928 Windle ..... 42/70.06
3,624,945 12/1971 Foote ..... 42/70.11
4,499,681 2/1985 Bako et al. ..... 42/70.07
4,509,281 4/1985 Dreiling et al. ..... 42/70.07
5,012,606 5/1991 McNulty, Jr. ..... 42/70.11

FOREIGN PATENT DOCUMENTS 968669 9/1964 United Kingdom ..... 42/70.07

*Primary Examiner*—Stephen Johnson
*Attorney, Agent, or Firm*—Ladas & Parry

[57] ABSTRACT

A gun lock (10) to enclose the trigger and trigger guard of a gun. The gun lock (10) includes co-operating housing halves (60 and 61) which encompass the trigger and trigger guard. Extending between the housing halves (60 and 61) is an Alan screw which is tensioned and access to the Alan screw (73) is prevented by means of a cylinder lock locatable in a passage in one of the housing halves. The gun lock (10) can only be released upon removal of the cylinder lock providing access to the head of the Alan screw (73).

9 Claims, 8 Drawing Sheets

GUN LOCK

FIELD OF THE INVENTION

The invention pertains to gun locks and more particularly to a gun lock having a split casing for enclosing a trigger guard.

BACKGROUND OF THE INVENTION

Gun locks have frequently included just a single lock which secures the gun to a rack which upon being unlocked renders the gun ready for use. In heated situations there is nothing to inhibit or delay use of the gun causing the user to reconsider use of the gun.

The above discussed gun locks also do not permit the gun to be transported while still being maintained in a locked configuration.

OBJECT OF THE INVENTION

It is the object of the present invention to overcome or substantially ameliorate the above disadvantages.

SUMMARY OF THE INVENTION

There is disclosed herein a gun lock for a gun having a trigger and trigger guard, said lock comprising:

a pair of housing halves co-operating to enclose a hollow within which the trigger and trigger guard are to be located. The housing halves being joined by movements substantially normal to the longitudinal axis of the gun so that the housing halves are substantially located on opposite sides of the trigger, a transverse passage extending through a first one of the halves, engagement means in the other half and transversely aligned with said passage;

bolt means extending through said passage and selectively engageable with said engagement means, said bolt means being operable to secure the two halves together; and a barrel lock removably mounted within said passage to prevent access to said bolt means and therefore inhibit removal of said bolt means until the barrel lock has been removed.

BRIEF DESCRIPTION OF THE DRAWINGS

A preferred form of the present invention will now be described by way of example with reference to the accompanying drawings wherein:

In FIGS. 11 to 18, there is schematically depicted a gun lock 60. The gun lock 60 includes co-operating housing halves 61 and 62. The housing halves 61 and 62 are hollow and co-operate to enclose a space within which the trigger and trigger guard of a weapon are located. The housing half 61 includes a shell 63 having a flange 64. Integrally formed with the flange 64 is a lock housing 65. The lock housing 65 is formed with a passage 66 which extends through the housing half 61. More particularly, the passage 66 includes a sub-passage 67 and an enlarged passage portion 68. The passage portion 68 is also formed with annular grooves 69 and 70. The sub-passage extends through an annular flange 71. It should be appreciated that the passage 66 extends generally transverse of the housing 61 and more particularly is transverse of the longitudinal axis of the gun. Still further, the passage 66 is adapted to receive an alan screw 72 having a shank 73 and a head 74. The head 74 abuts the flange 71 but the shank 73 passes through the sub-passage 67. The enlarged passage portion 68 is adapted to receive a cylinder lock as discussed with the previous embodiment. The cylinder lock would have a radially movable abutment to selectively engage within the annular recess 70 to thereby retain the cylinder lock in position. When the cylinder lock is in position, the head 74 of the alan screw 72 is not accessible.

Figure 1:
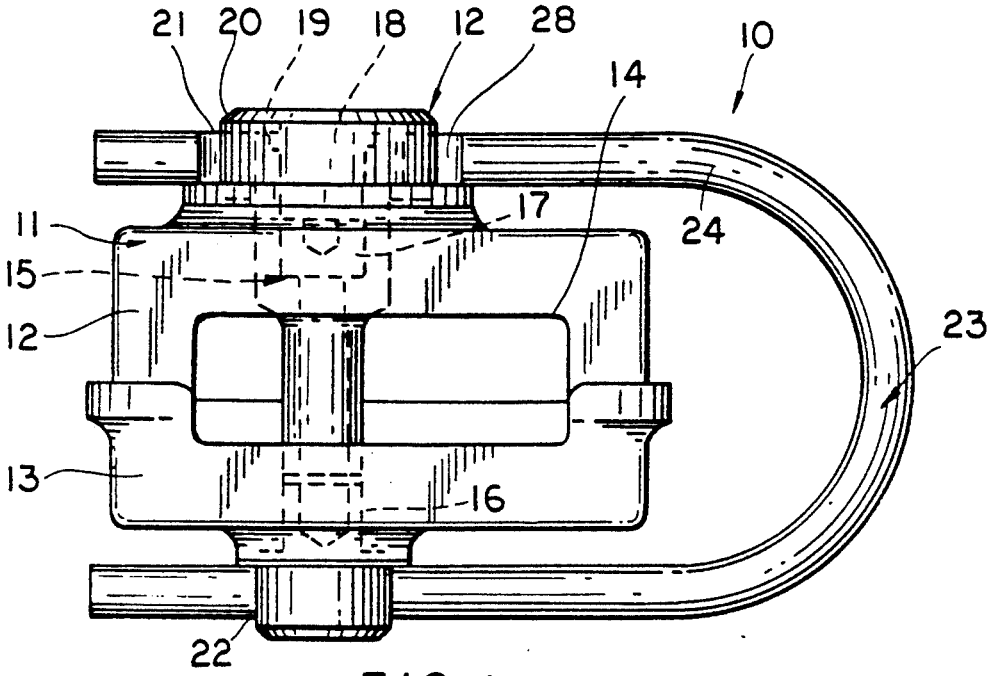
FIG. 1 is a top plan view of a gun lock according to the present invention.

The housing half 62 co-operates with the housing half 61. The housing half 62 includes a shell 75 terminating with a flange 76. The flange 76 is stepped so as to have an annular lip 77 against which the annular flange 64 abuts when the two halves are brought into mating engagement. The shell 75 is integrally formed with a threaded portion 78 having a threaded passage 79 which threadably receives the end of the alan screw 73.

The housing half 61 may also be provided with a further passage 80, and the housing half 62 provided with a still further passage 81, with the passages 80 and 81 being adapted to receive a "U-shaped" shackle or yolk. The passage 80 intersects with a portion of the passage 66, so that if the shackle is provided with cut-out portions, the cylinder lock is locatable to be engaged with one of the cut-out portions to prevent removal of the shackle. The shackle may then be employed to secure the gun lock 60 and therefore the gun to a rack. Accordingly, the shackle cannot be withdrawn until the cylinder lock has also been withdrawn The other end of the shackle is received within the passage 81.

It should be appreciated that the threaded portion 78 is transversely aligned with the passage 66.

In FIGS. 19 to 24, there is schematically depicted a modification of the gun lock 60. In this particular embodiment the housing halves have been enlarged and shaped so as to engage not only the trigger and trigger guard, but also to enclose the handle of an assault weapon. In this particular embodiment, the corresponding portions of the lock have been given the same numerals as the embodiment of FIGS. 11 to 18.

Figure 25:
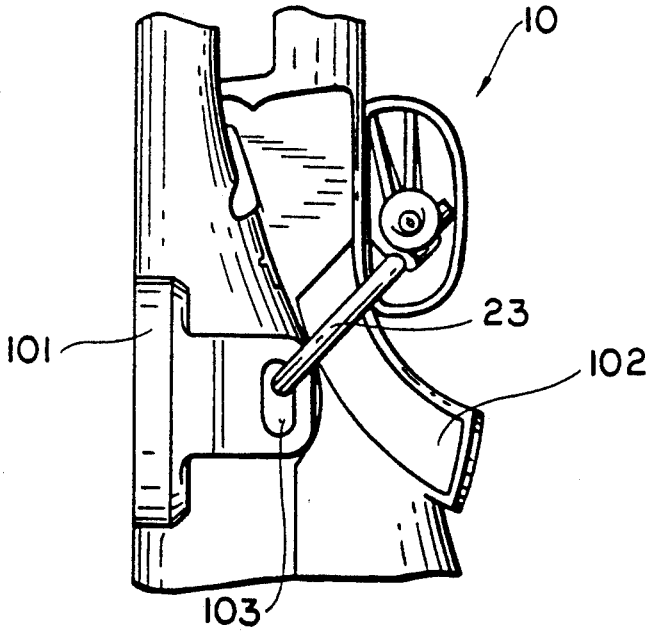
FIG. 25 is a schematic side elevational view of a housing locked into position over the trigger of a gun, and a shackle supporting the gun to a wall bracket.

In the above described embodiments of FIGS. 11 to 24, the housing halves 61 and 62 are brought into mating engagement so as to encompass at least the trigger guard and trigger. Thereafter, the alan screw 73 is inserted through the passage 66 and threadably engaged with the aligned passage 79. It is then tensioned to securely fasten the halves together. Thereafter, the cylinder lock is placed in the enlarged passage portion 68 and the key activated so that the cylinder lock is maintained in position. Normally the cylinder lock will consist of a cylindrical housing within which there is mounted a key operable barrel. The shackle may also be employed to secure the lock and gun to a bracket. Such a bracket 101 as depicted in FIG. 25 is securely mounted to a vertical surface such as a wall. The bracket 101 depicted comprises an eyelet 103 through which shackle 23 passes for the purpose of securing the gun 102 in place adjacent to the wall. This arrangement is an alternative to the use of a safe for the storage of the gun 102 therein. The shackle is first located so as to protrude into the passages 80 and 81 and thereafter the cylinder lock inserted to maintain the shackle in position. The reverse procedure must take place to expose the trigger guard and trigger. In this respect it should be appreciated that there is a two part operation. That is the cylinder lock must be removed and thereafter an alan key manipulated to remove the alan screw 73. This does take some time and inhibits rash use of the gun.

The above described embodiments allow the lock gun also to be maintained around the trigger and trigger guard even during transportation of the gun.

BEST MODE AND OTHER EMBODIMENTS OF THE INVENTION

As shown in FIG. 1, a gun lock 10 according to the teachings of the present invention comprises a split casing 11 through which passes a bolt assembly 25. The split casing 11 further comprises two shells 12. 13. An upper surface of one or both shells 12, 13 is recessed so as to form an opening 14 on an upper surface of the casing 11. The opening 14 is for receiving the trigger guard of a gun. Each of the casing shells 12, 13 also includes an opening through which passes the bolt assembly 25. The bolt assembly comprises a sleeve 15, a nut 16 and a bolt 17. The bolt 17 passes through a bore in the sleeve 15 to engage a threaded opening in the nut 16. Insertion of the bolt 17 through the bore of the sleeve 15 and into the threaded recess of the nut 16. Threading the bolt 17 into the nut 16 has the effect of clamping the shells 12, 13 together. When located around the trigger guard of a gun, these components will prevent the gun from being inadvertently discharged. In order to undo the lock, it will be necessary to remove the bolt 17. The time it takes in which to unscrew the bolt 17 is a deterrent to the immediate discharge of the gun which may otherwise follow a domestic dispute or other heated argument.

As an added precaution, the sleeve 15 may be formed with a counter bore 18 at one end. By providing the counter bore 18 with a peripheral groove 19, the counter bore 18 can receive a conventional lock cylinder, of the type depicted in FIG. 10. Thus, removal of the bolt 17 can be obstructed by a locking cylinder, the removal of which with a key acts as a further deterrent to the removal of the bolt 17.

As yet a further precaution, the sleeve 15 may be provided with a head 20 including a transverse bore 21, which transverse bore 21 communicates with the counter bore 18. Similarly, the nut 16 may be provided with a transverse bore 22. In this way, the straight legs of a U-shaped yoke 23 may be inserted through the transverse bores 21, 22. A scalloped portion 28 on one leg 24 of the shackle or yoke 23 is positionable so as to admit the axial insertion of the locking cylinder into the counter bore 18. When the locking cylinder is locked with its tongue inserted in the groove 19, the yoke 23 can not be removed. This adds yet a further layer of security against the inadvertent or undesirable discharge of the gun.

Figure 2:
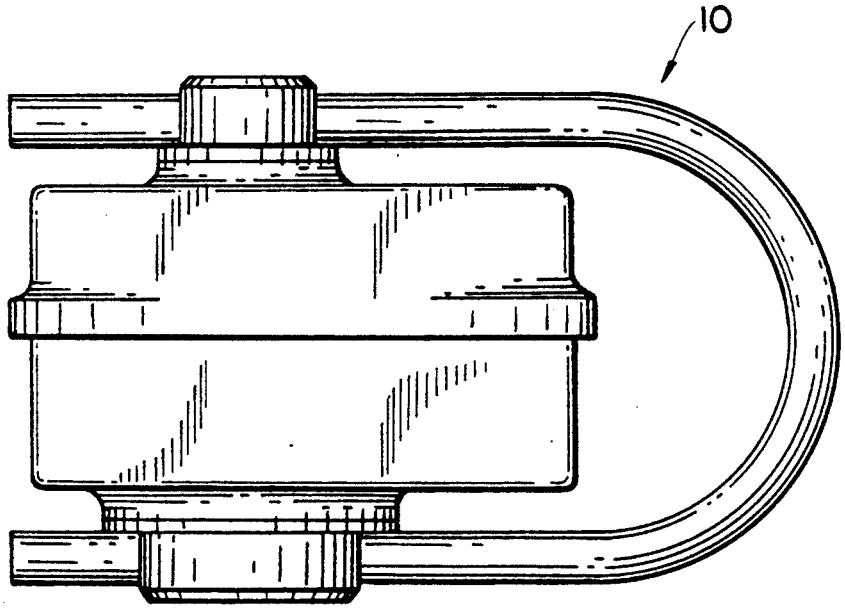
FIG. 2 is a bottom plan view of the device depicted in FIG. 1.

FIG. 2 depicts the underside of the gun lock 10 of the present invention.

Figure 3:
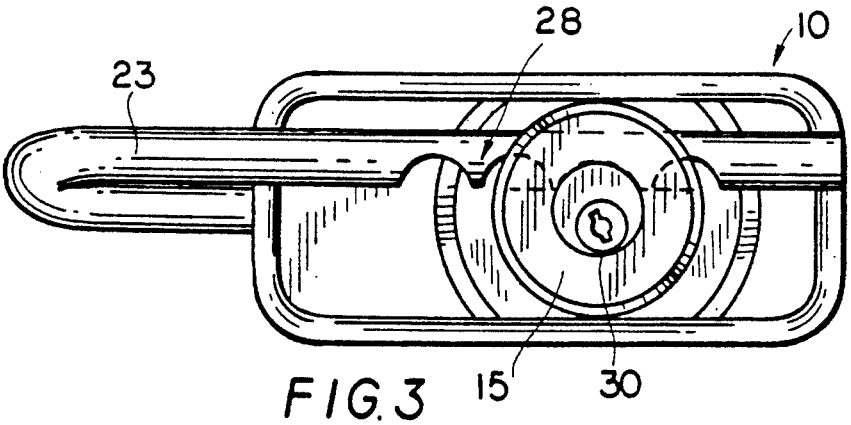
FIG. 3 is a side elevation of the device depicted in FIG. 1.

FIG. 3 illustrates a side view of a gun lock 10 of the present invention. A lockable cylinder 30 is inserted into the counter bore 18 of the sleeve 15. Note how the lock interferes with the scalloped portion 28 to prevent removal of the yoke 23 when the cylinder 30 is in place.

Figure 4:
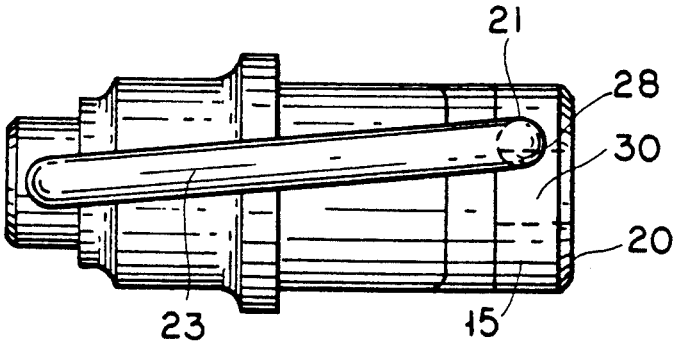
FIG. 4 is an end elevation of the device depicted in FIG. 1.

As shown in FIG. 4, the transverse bore 21 of the sleeve 15 may be displaced from the centre line of the enlarged head 20 so that the scalloped portions 28 of the yoke 23 can engage the periphery of the locking cylinder 30.

Figure 5:
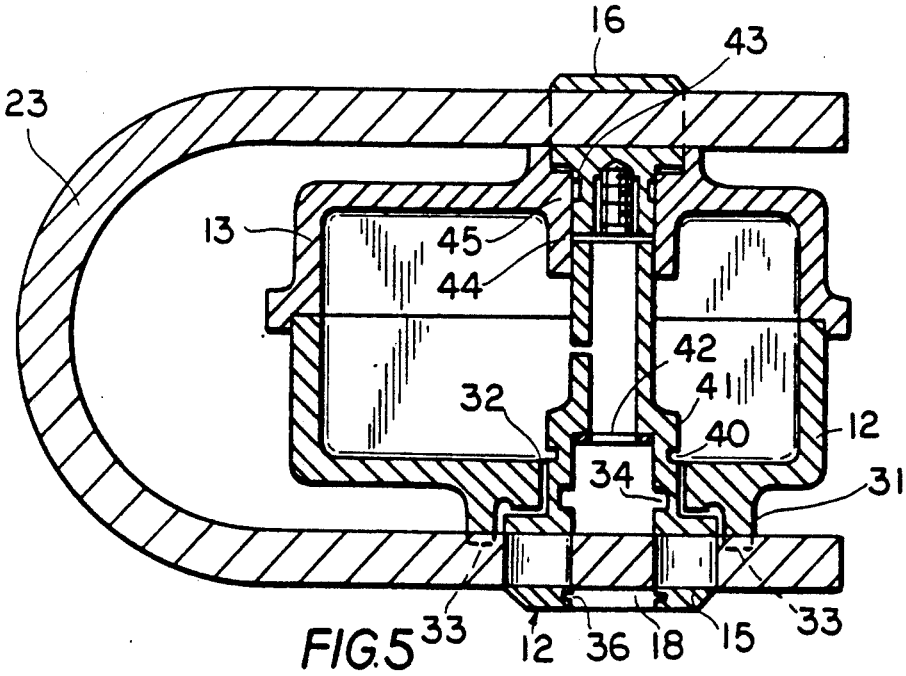
FIG. 5 is a cross-sectional view of the device depicted in FIG. 1.

The cross-sectional view of FIG. 5 depicts several other optional features of the invention. As depicted therein, one of the casing shells 12 may include a peripheral rim 31 around the transverse opening 32 through which the bolt assembly 12 passes and into which the head 20 fits. The upstanding rim 31 may include opposed recesses 33 into which the yoke 23 may seat. This prevents undesirable rotation of the yoke 23. The sleeve 15 of the bolt assembly is shown as including a counter bore 18 which is adapted to receive both the head of the bolt 17 and the locking cylinder 30. The counter bore 18 is shown as including a first peripheral groove 34 for receiving the tongue 35 of the locking cylinder 30 and a second peripheral groove 36 for receiving an 0-ring. The purpose of the 0-ring in the groove 36 is to frictionally engage the periphery of the locking cylinder 30, which frictional engagement acts as a brake resisting the rotation of the locking cylinder 30 within the bore 18 when the key 37 is operated. The sleeve 15 also includes a third peripheral groove 40 on an exterior surface 41. This third peripheral groove 40 is for retaining a circlip or split fastener which rotatably maintains the sleeve 15 in position with respect to the casing shell 12. A hardened washer 42 is preferably located at the base of the counter bore 18. The hardened washer 42 acts as a thrust bearing for the bolt 17, thus preventing undesirable wear of the sleeve 15 and ensuring smooth operating action of the bolt 17.

The nut 16 is also shown as having a peripheral groove 43 on an exterior surface. The casing shell 13 which retains the nut 16 may be provided with an integral internal bushing 44. The bushing acts as an extension to the transverse opening through which the nut passes and enhances the alignment between the sleeve 15 and the nut 16. A bore 45 may be provided adjacent the transverse opening through which the nut 16 passes. A roll pin or other suitable fastener may be inserted through the bore 45 into the slot 43. Thus, the nut 16 will be retained in the shell 13 while the roll pin or fastener is lodged within the bore 45.

Figure 6:
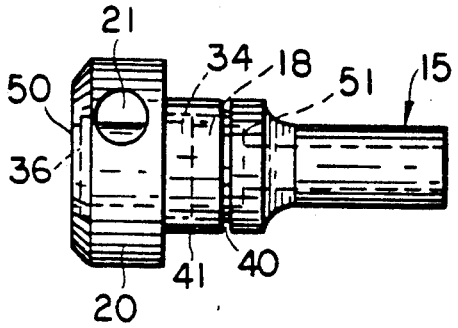
FIG. 6 is a bolt sleeve according to the teachings of the present invention.

FIG. 6 depicts, in more detail, the sleeve 15 of the bolt assembly 12. As depicted therein, the groove 34 for retaining the tongue 35 of the locking cylinder 30 is located between the main opening 50 and the base 51 of the counter bore 18. The 0-ring groove 36 in the counter bore 18 is located close to the main opening 50.

Figure 7:
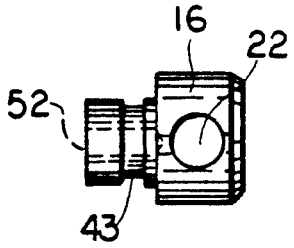
FIG. 7 is a nut which cooperates with the bolt sleeve depicted in FIG. 6.

As shown in FIG. 7, the transverse opening 22 through the nut 16 is preferably diametrical. The threaded opening 52 preferably does not extend into the transverse opening 22.

Figure 8:
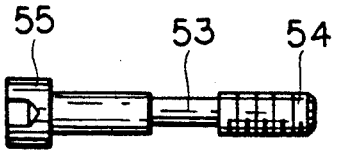
FIG. 8 is a bolt which cooperates with the sleeve and nut depicted in FIGS. 6 and 7.

As shown in FIG. 8, a shoulder bolt 53 forms an element of the bolt assembly 12. The threads 54 engage the threaded opening 52 of the nut 16. The head 55 must be rotatable within the counter bore 18.

Figure 9:
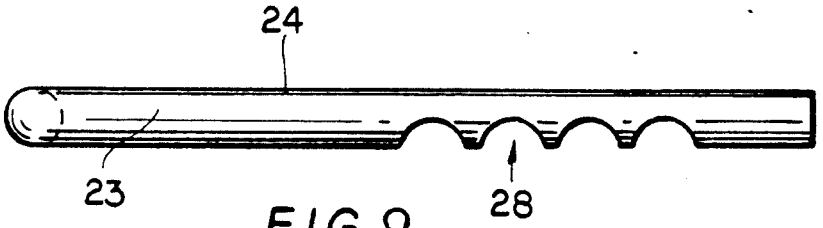
FIG. 9 is a side elevation of a yoke according to the teachings of the present invention.

As shown in FIG. 9, the yoke 23 preferably includes a scalloped portion 28 on one leg 24. Thus, the yoke 23 can be positioned with respect to the locking cylinder 30 in any one of a number of different positions.

Figure 10A:
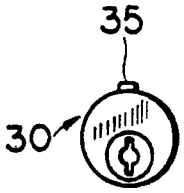
FIG. 10(A-B) depicts both end and side elevations of a conventional lock cylinder adaptable to the present invention.
Figure 10B:
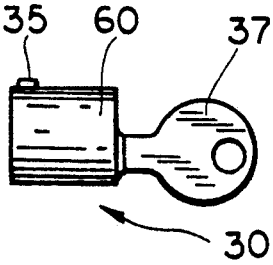
Figure 11:
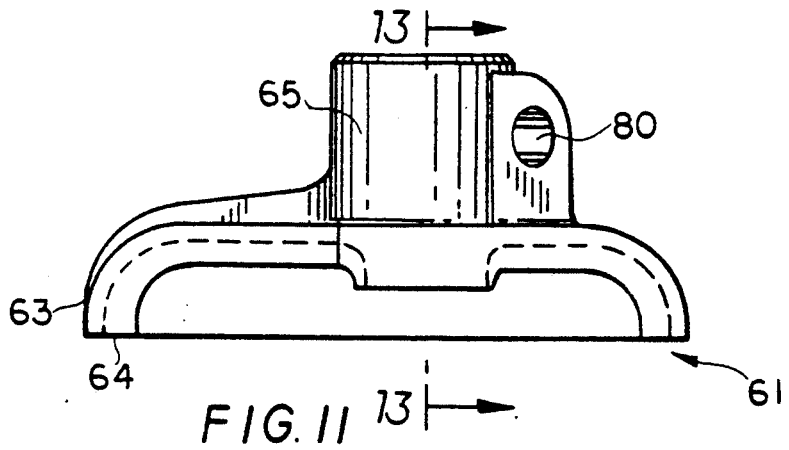
FIG. 11 is a schematic side elevation of a housing half to enclose the trigger and trigger guard of a gun.
Figure 12:
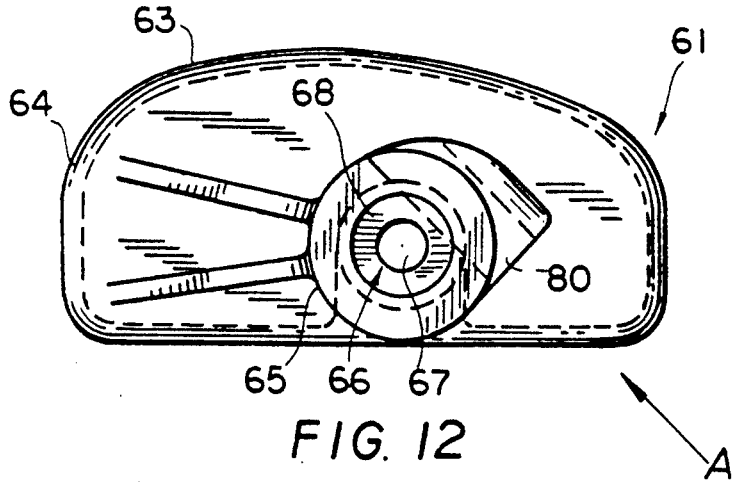
FIG. 12 is a schematic front elevation of the housing half of FIG. 11.
Figure 13:
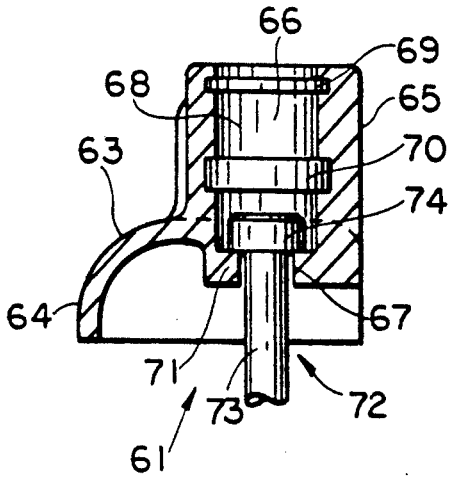
FIG. 13 is a schematic sectioned end elevation of the housing half of FIG. 11, sectioned along the line B—B.
Figure 14:
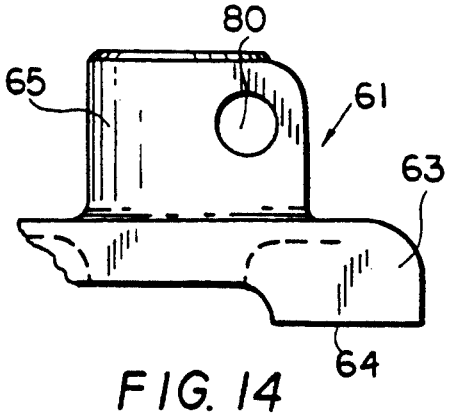
FIG. 14 is a schematic elevation of the housing half of FIG. 12 viewed in the direction of the arrow A.
Figure 15:
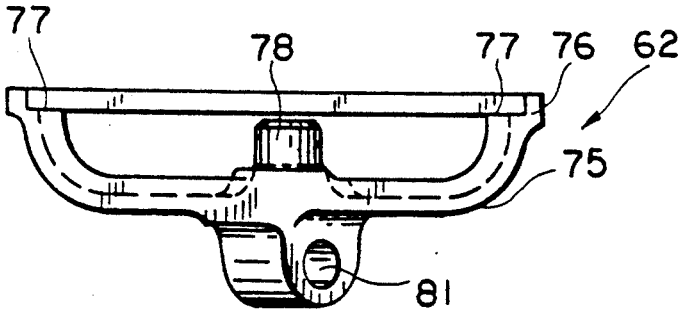
FIG. 15 is a schematic side elevation of a further housing half to co-operate with that of FIG. 11.
Figure 16:
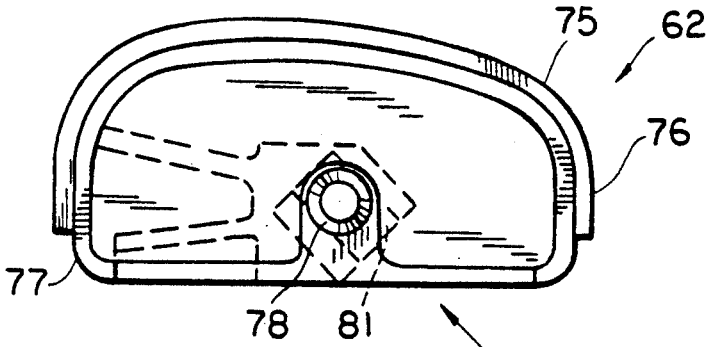
FIG. 16 is a schematic front elevation of the housing half of FIG. 15.
Figure 17:
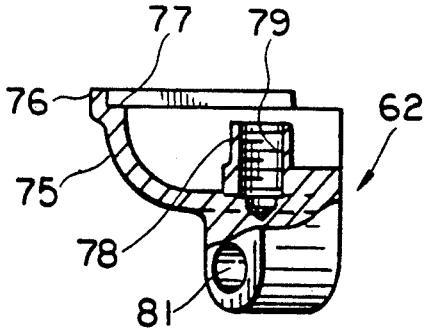
FIG. 17 is a schematic part sectioned end elevation of the housing half of FIG. 15.
Figure 18:
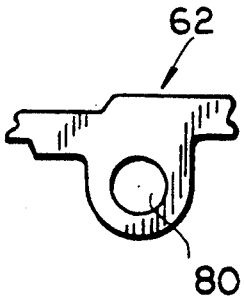
FIG. 18 is a schematic elevation of the housing half of FIG. 16 viewed in the direction of the arrow C.
Figure 19:
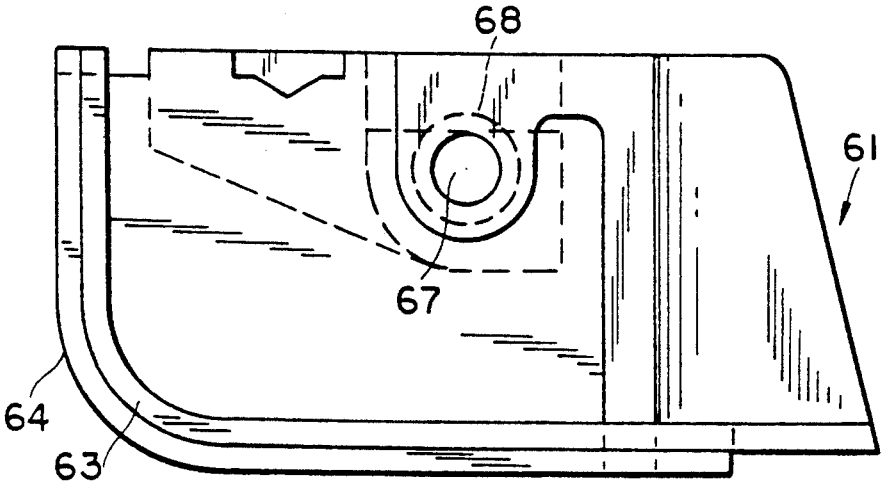
FIG. 19 is a schematic elevation of a housing half to engage a further housing half to encompass the trigger, trigger guard and handle of an assault weapon.
Figure 20:
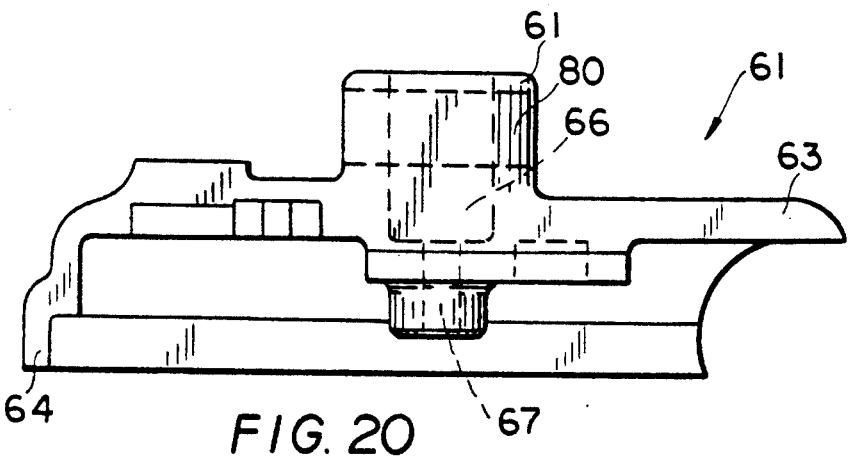
FIG. 20 is a schematic end elevation of the housing half of FIG. 19.
Figure 21:
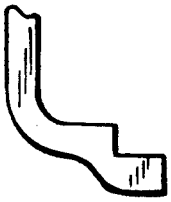
FIG. 21 is a schematic elevation of a portion of the housing half of FIG. 19.
Figure 22:
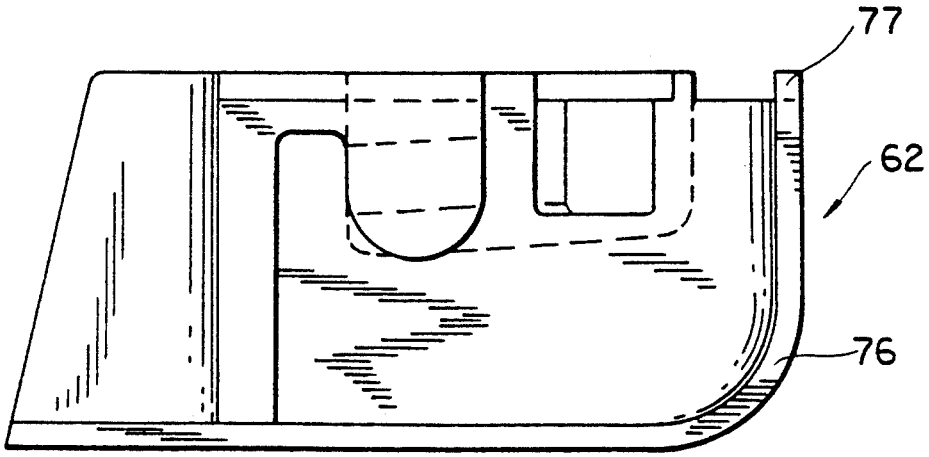
FIG. 22 is a schematic front elevation of a further housing half to co-operate with that of FIG. 19.
Figure 23:
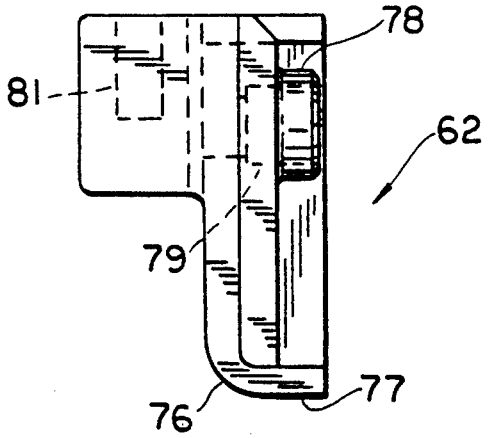
FIG. 23 is a schematic end elevation of the housing half of FIG. 22.
Figure 24:
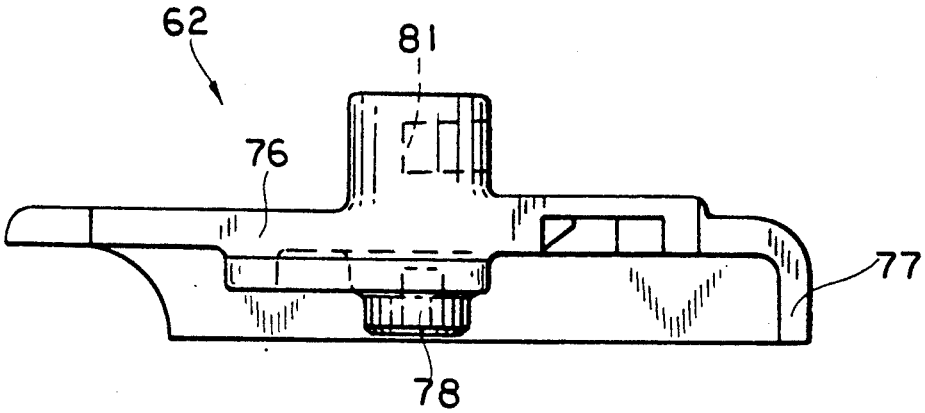
FIG. 24 is a schematic side elevation of the housing half of FIG. 22.

As shown in FIG. 10, a conventional locking cylinder 30 includes a cylindrical periphery 60 which fits within the counter bore 18 and which may be frictionally engaged by an 0-ring within the peripheral groove 36.

While the gun lock of the present invention is adaptable to a variety of materials and dimensions, the following are provided by way of example. It is preferred that the casing 12 be an investment casting. Investment casting provides a strong, durable case. The casing should be about 5 mm thick. The top opening 14 of the casing should be about 24 mm wide and about 100 mm long when the casing is assembled. It is preferred that the yoke 23 be about 10 mm in diameter. A 16 mm diameter locking cylinder is preferred. Accordingly, the individual scallops in the yoke 23 should be 8 mm radius and recessed about 3.5 mm into the surface of the yoke.

While the present invention has been described with reference to particular materials and details of construction, these should be understood as having been provided by way of example and not as limitations to the scope or spirit of the invention.

What I claim is:

1. A gun lock for a gun having a trigger and trigger guard, said lock comprising:

a pair of housing halves co-operating to enclose a hollow within which the trigger and the trigger guard are to be located, the housing halves being joined by movements substantially normal to the longitudinal axis of the gun so that the housing halves are substantially located on opposite sides of the trigger, a transverse passage extending through a first one of the halves, a threaded passage in the other half and transversely aligned with said transverse passage;

an alan screw extending through said traverse passage and selectively engageable with said threaded passage, said alan screw being operable to secure the two halves together; and a locking means removably mounted within said passage to prevent access to said alan screw and therefore inhibit removal of said alan screw until the locking means has been removed.

2. The gun lock of claim 1 wherein the locking means is a barrel lock.

3. The gun lock of claim 1, wherein said alan screw is removable from said other housing half.

4. A gun lock for a gun having a trigger and trigger guard, said lock comprising:

a pair of housing halves co-operating to enclose a hollow within which the trigger and the trigger guard are to be located, the housing halves being joined by movements substantially normal to the longitudinal axis of the gun so that the housing halves are substantially located on opposite sides of the trigger, a transverse passage extending through a first one of the halves, engagement means in the other half and transversely aligned with said passage;

bolt means extending through said passage and selectively engageable with said engagement means, said bolt means being operable to secure the two halves together;

a locking means removably mounted within said passage to prevent access to said bolt means and therefore inhibit removal of said bolt means until the barrel lock has been removed; and a shackle passage intersecting with said transverse passage, a further shackle passage formed in said other half, and a shackle to extend between said shackle passages and securable in position upon location of said locking means in said transverse passage.

5. The gun lock of claim 4, wherein the locking means is a barrel lock.

6. The gun lock of claim 4, wherein said engagement means is a threaded passage in said other half, and said bolt means is a threaded bolt.

7. The gun lock of claim 6, wherein said threaded bolt is an alan screw.

8. The gun lock of claim 4, wherein said bolt means is removable form said other housing half.

9. The gun lock of claim 4, further comprising a bracket to be secured to a vertical surface, said bracket having an aperture therethrough, said aperture to receive said shackle so as to secure the gun relative to the vertical surface.

* * * * *